US011085721B1

(12) United States Patent
Liu

(10) Patent No.: US 11,085,721 B1
(45) Date of Patent: Aug. 10, 2021

(54) SAFETY DEVICE FOR CROSSBOW

(71) Applicant: Chi-Chang Liu, Taichung (TW)

(72) Inventor: Chi-Chang Liu, Taichung (TW)

(73) Assignee: POE LANG ENTERPRISE CO., LTD., Taichung (TW)

( * ) Notice: Subject to any disclaimer, the term of this patent is extended or adjusted under 35 U.S.C. 154(b) by 0 days.

(21) Appl. No.: 16/853,761

(22) Filed: Apr. 21, 2020

(51) Int. Cl.
*F41B 5/12* (2006.01)
*F41A 17/46* (2006.01)
*F41B 5/14* (2006.01)

(52) U.S. Cl.
CPC ..... *F41A 17/46* (2013.01); *F41B 5/12* (2013.01); *F41B 5/1469* (2013.01)

(58) Field of Classification Search
CPC ..... F41B 5/12; F41B 5/1469; F41A 17/46; F41A 19/10
USPC ..... 124/25, 31, 40
See application file for complete search history.

(56) References Cited

U.S. PATENT DOCUMENTS 5,598,829 A * 2/1997 Bednar ..... F41A 17/28 124/25
5,649,520 A * 7/1997 Bednar ..... F41B 5/12 124/25
6,736,123 B1 * 5/2004 Summers ..... F41A 17/46 124/25
6,802,304 B1 * 10/2004 Chang ..... F41B 5/1469 124/25
7,588,022 B2 * 9/2009 Chang ..... F41B 5/123 124/25
7,770,567 B1 * 8/2010 Yehle ..... F41B 5/12 124/25
8,240,299 B2 * 8/2012 Kronengold ..... F41A 11/02 124/25
8,522,761 B1 * 9/2013 Chu ..... F41A 17/46 124/25
8,651,094 B2 * 2/2014 Matasic ..... F41B 5/12 124/25
8,899,218 B2 * 12/2014 Kempf ..... F41B 5/12 124/35.1
8,985,091 B2 * 3/2015 Miao ..... F41A 19/12 124/35.1
9,255,754 B1 * 2/2016 Kempf ..... F41B 5/12
9,404,705 B2 * 8/2016 Kennedy ..... F41B 5/12
9,435,605 B2 * 9/2016 McPherson ..... F41B 5/12
9,506,715 B2 * 11/2016 Hughes ..... F41A 17/00
9,551,544 B1 * 1/2017 Kempf ..... F41B 5/12
9,689,638 B1 * 6/2017 Yehle ..... F41A 17/46
9,733,041 B2 * 8/2017 Khoshnood ..... F41B 5/1469
10,012,468 B1 * 7/2018 Kempf ..... F41B 5/12
10,066,894 B1 * 9/2018 Kempf ..... F41B 5/12
(Continued)

*Primary Examiner* — Alexander R Niconovich

(57) ABSTRACT

A safety device for a crossbow includes a control box connected to the shooting device of the crossbow. The control box includes a case, an operation assembly and a pivotal member. The operation assembly is located in the case and the operated is operated to be a string-cocked mode. An activation member is pivotably connected to the case and located beneath the operation assembly. The activation member includes a stop which is located in the box. When the operation assembly is operated to the string-cocked mode, the string cocked and no arrow is loaded. The operation assembly does not restrict the activation member. The stop is restricted by the pivotal member so that the activation member cannot be pivoted, and the trigger cannot be pulled.

7 Claims, 8 Drawing Sheets

(56) References Cited

U.S. PATENT DOCUMENTS

| | | | | |
|---|---|---|---|---|
| 10,215,520 | B1 * | 2/2019 | Liu | F41B 5/12 |
| 10,215,522 | B1 * | 2/2019 | Kempf | F41B 5/12 |
| 10,401,117 | B1 * | 9/2019 | Rowzie, Jr. | F41B 5/12 |
| 10,508,884 | B1 * | 12/2019 | Chen | F41A 17/46 |
| 10,605,555 | B1 * | 3/2020 | Shaffer | F41A 19/10 |
| 10,866,055 | B1 * | 12/2020 | Hensel | F41A 19/06 |
| 2009/0064978 | A1 * | 3/2009 | Matasic | F41B 5/12 124/35.1 |
| 2014/0182574 | A1 * | 7/2014 | Darlington | F41A 17/56 124/35.1 |

* cited by examiner

SAFETY DEVICE FOR CROSSBOW

BACKGROUND OF THE INVENTION

1. Fields of the Invention

The present invention relates to a crossbow, and more particularly, to a safety device for restricting the trigger from being pulled when the string is cocked.

2. Descriptions of Related Art

The modern conventional crossbows generally include a safety device which is operated by the user to prevent the trigger from being pulled after the string is cocked and before the arrow is loaded in the barrel groove of the crossbow. If the trigger is accidentally pulled, the string can damage and injure the user.

The present invention intends to provide a safety device for a crossbow to eliminate the shortcomings mentioned above.

SUMMARY OF THE INVENTION

The present invention relates to a safety device for a crossbow. The safety device comprises a control box connected to the shooting device of the crossbow. The control box includes a case, an operation assembly and a pivotal member. The operation assembly is located in the rear end of the case. The pivotal member is pviotably connected to the case and located in the front end of the case. The pivotal member is biased by a spring, and a portion of the pivotal member protrudes beyond the case and is located corresponding to the operation assembly. An activation member is pivotably connected to the case and located beneath the operation assembly. The activation member has a portion thereof partially protruding beyond the case. The activation member has a stop extending therefrom which is located in the case. The stop is located between the operation assembly and the trigger of the crossbow. A link is pivotably connected between the trigger and the portion of the activation member that protrudes beyond the case.

When the operation assembly is operated to be a string-cocked mode in which no arrow is loaded, the string is cocked by the operation assembly, and the operation assembly does not restrict the activation member. The stop is restricted by the portion of the pivotal member that protrudes beyond the case so that the activation member cannot be pivoted, and the trigger cannot be pulled by the link and the activation member.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
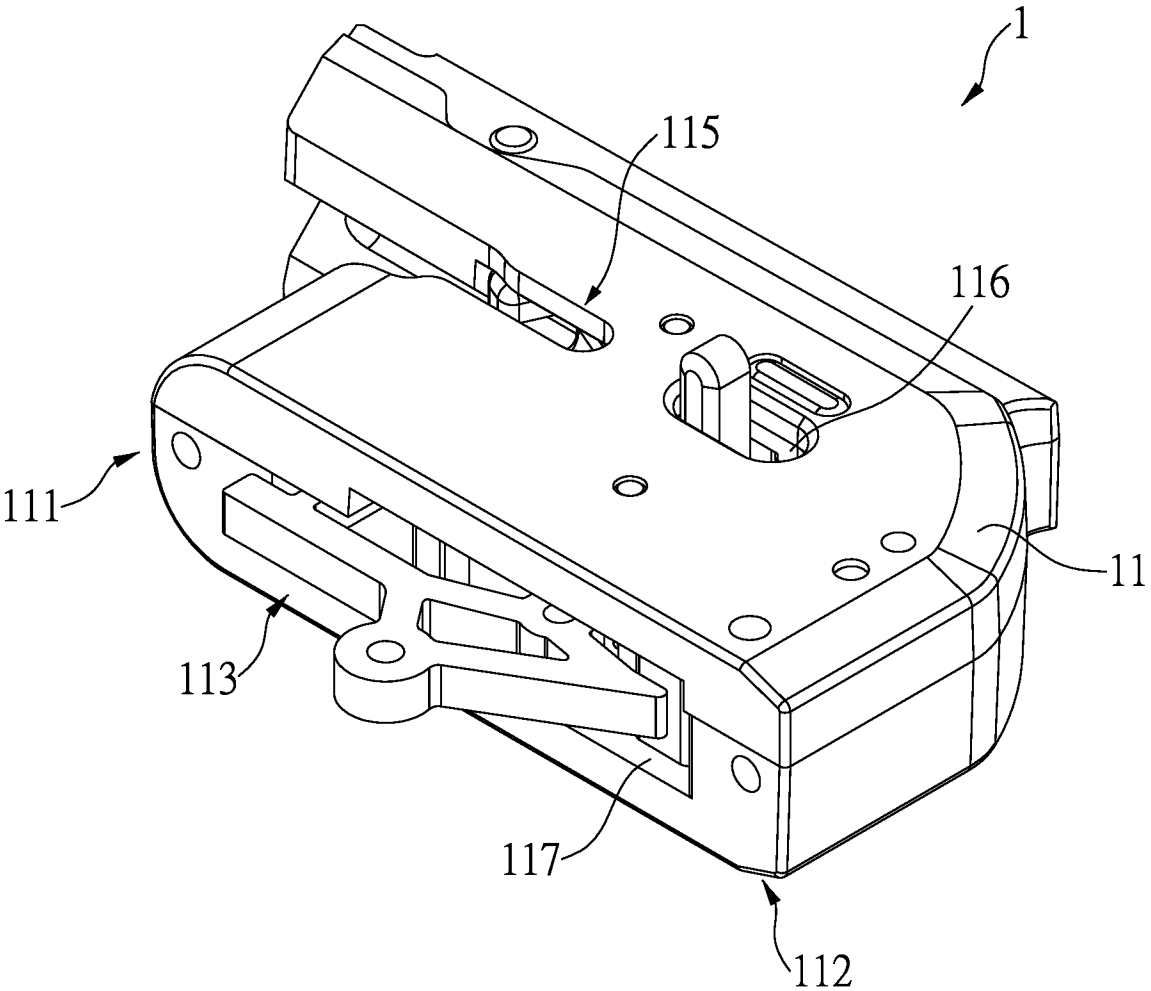
FIG. 1 is a perspective view to show the safety device of the present invention.
Figure 2:
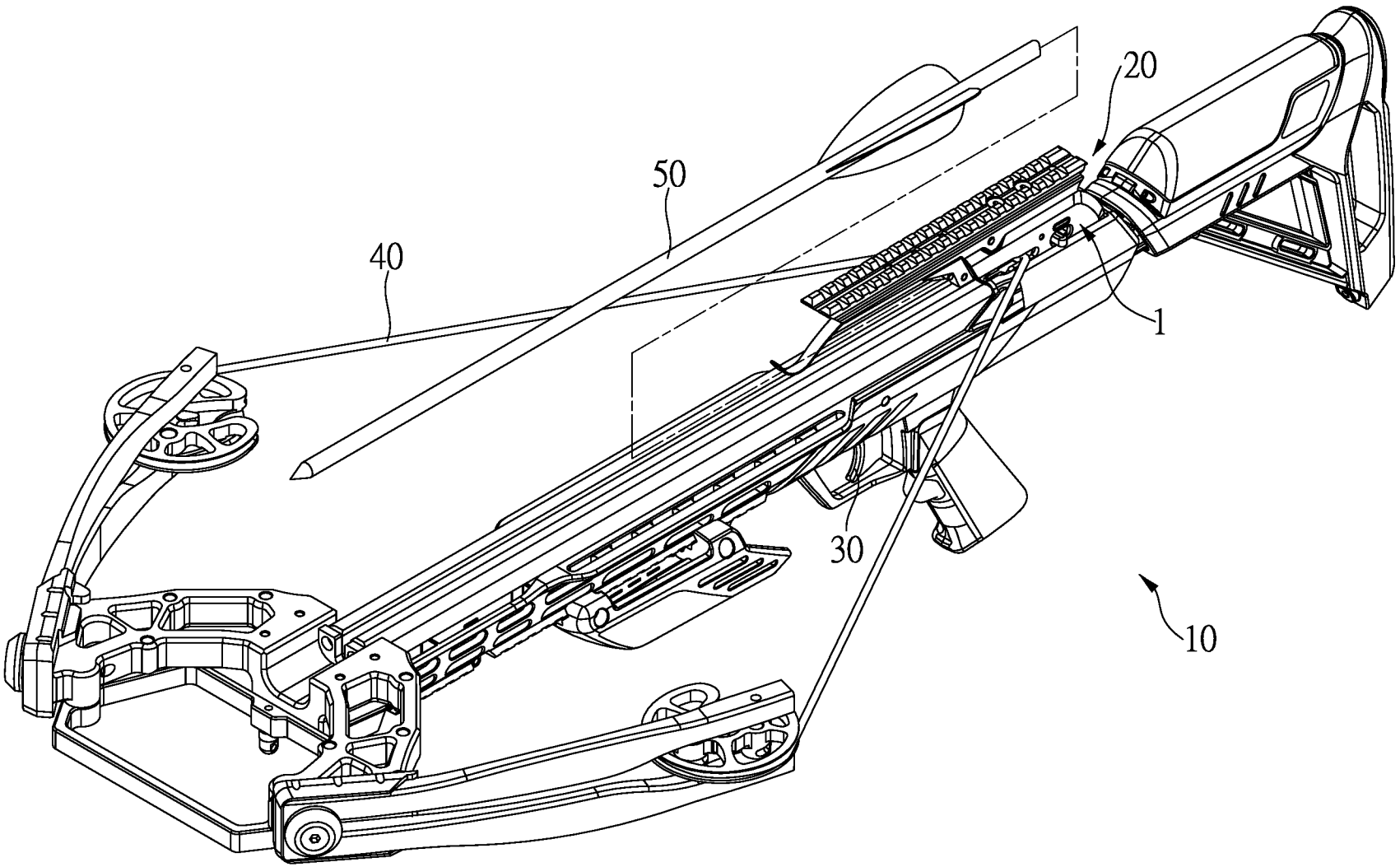
FIG. 2 is a perspective view to show a crossbow with the safety device of the present invention.

Referring to FIGS. 1 to 8, the crossbow 10 includes a barrel with a bow connected to the front end thereof, and a shooting device 20 is connected to the rear end of the barrel. A string 40 is connected to the bow. A trigger 30 is pivotably connected to the barrel.

The safety device of the crossbow 10 includes a control box 1 which is connected to the shooting device 20 and includes a case 11, an operation assembly 12 and a pivotal member 13. The operation assembly 12 is located in the rear end of the case 11. The pivotal member 13 is pviotably connected to the case 11 and located in the front end of the case 11. The pivotal member 13 is biased by a spring 2. A portion of the pivotal member 13 protrudes beyond the case 11 and is located corresponding to the operation assembly 12. An activation member 3 is pivotably connected to the case 11 and located beneath the operation assembly 12. The activation member 3 has a portion thereof partially protruding beyond the case. The activation member 3 has a stop 31 extending therefrom which is located in the case 11. The stop 31 is located between the operation assembly 12 and the trigger 30. A link 4 is pivotably connected between the trigger 30 and the portion of the activation member 3 that protrudes beyond the case 11. When the operation assembly 12 is operated to be a string-cocked mode in which no arrow 50 is loaded, the string 40 is cocked by the operation assembly 12. The operation assembly 12 does not restrict the activation member 3. The stop 31 is restricted by the portion of the pivotal member 13 that protrudes beyond the case 11 so that the activation member 3 cannot be pivoted, and the trigger 30 cannot be pulled by the link 4 and the activation member 3. Because, the trigger 30 cannot be accidentally pulled, so that the string 40 does not bounce back.

Figure 3:
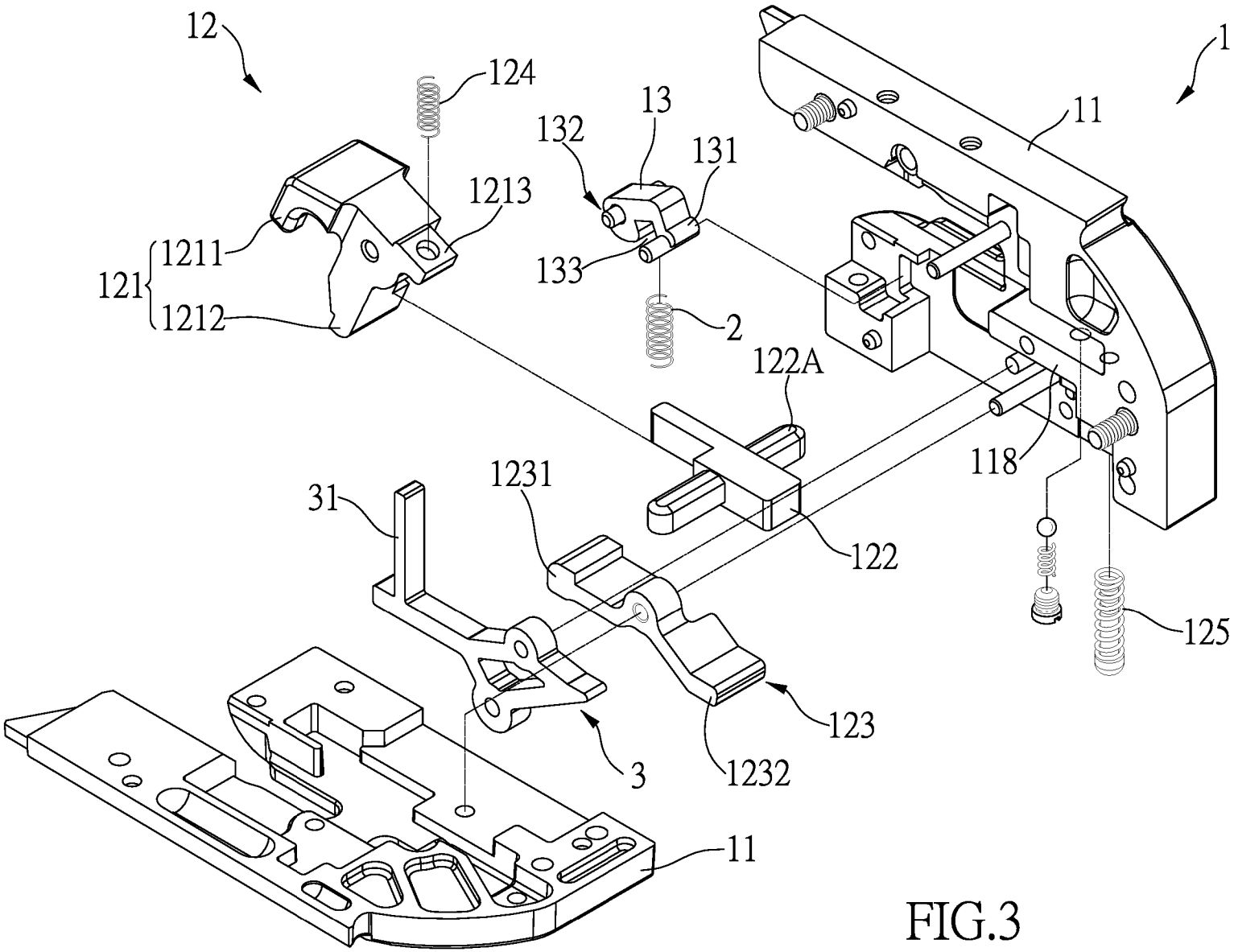
FIG. 3 is an exploded view of the safety device of the present invention.
Figure 4:
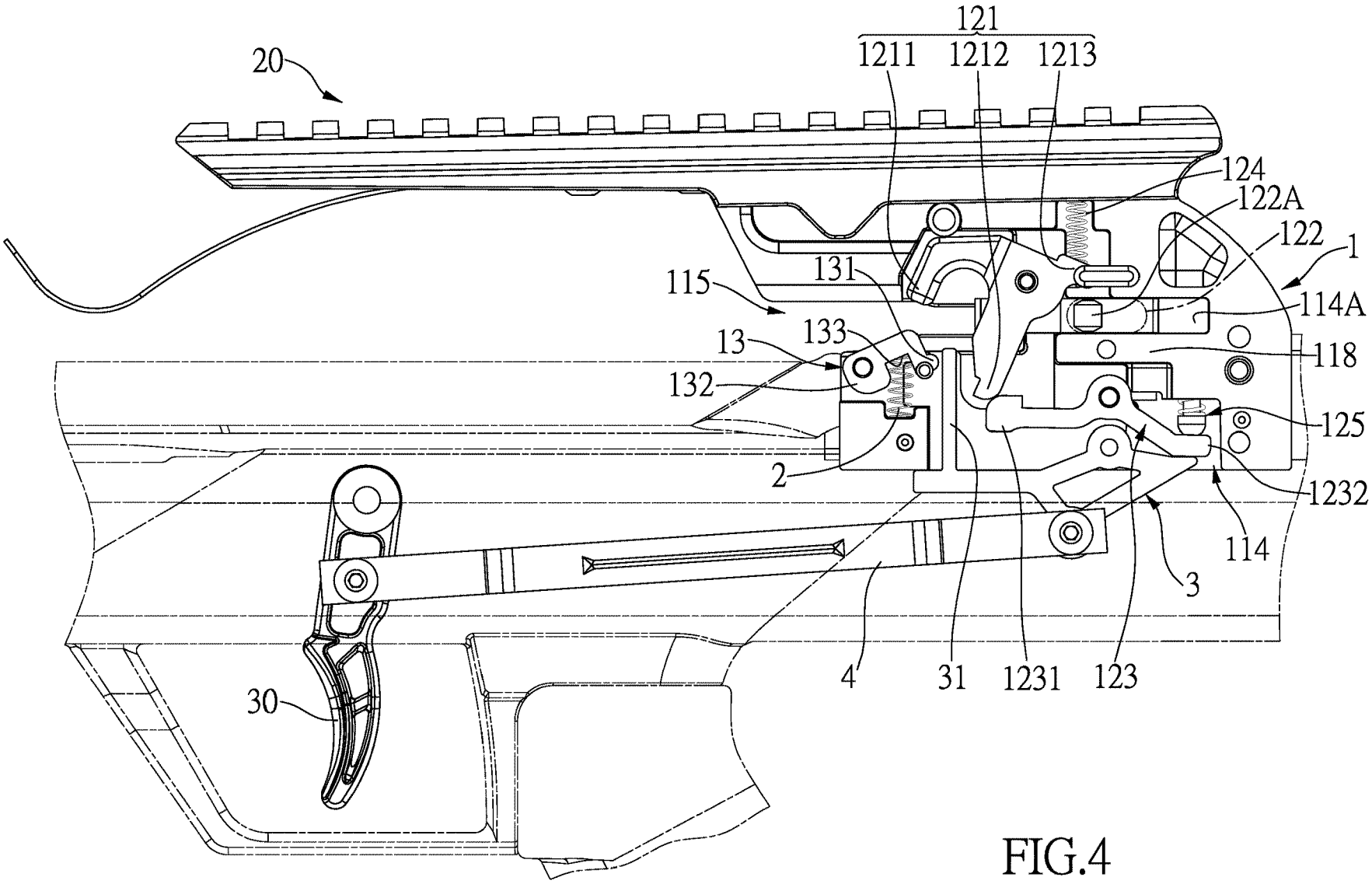
FIG. 4 shows the safety device of the present invention in the crossbow.
Figure 5:
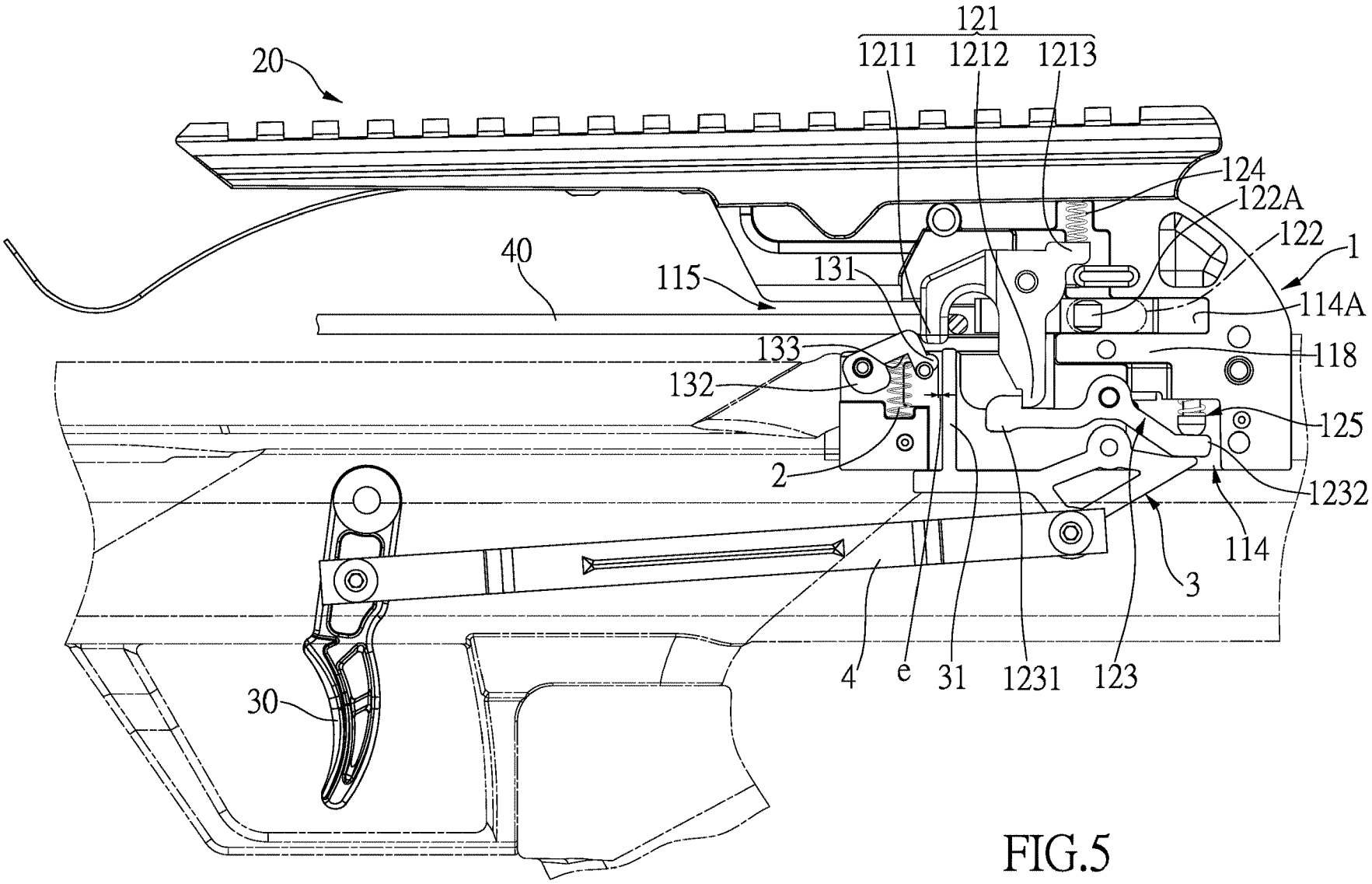
FIG. 5 shows that the crossbow is in the string-cocked mode, and no arrow is loaded.
Figure 6:
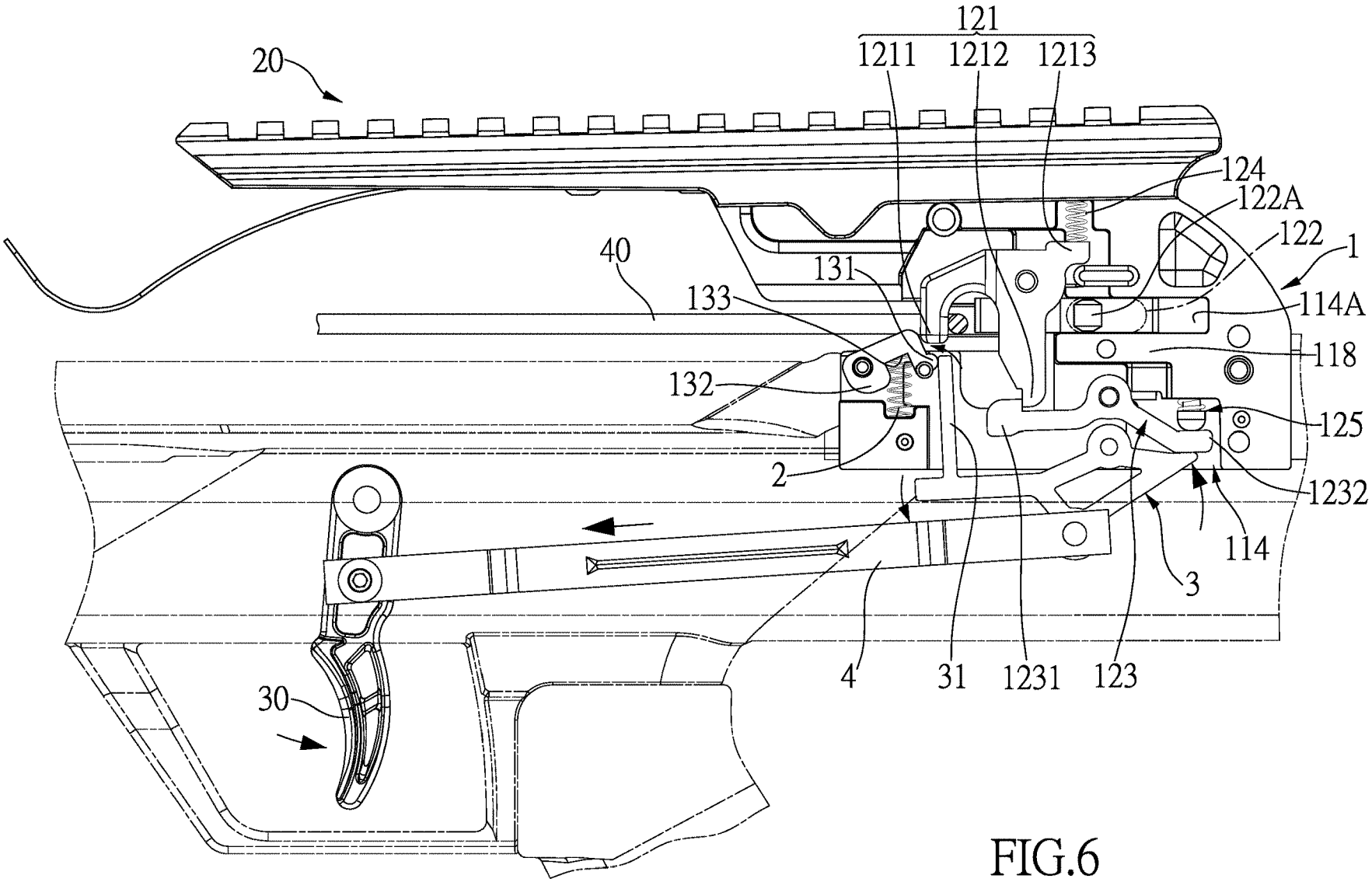
FIG. 6 shows that the trigger is pulled, the pivotal member stops the stop of the activation member to pivot.

As shown in FIG. 3, the pivotal member 13 includes an end portion 131, a pivot 132 and a recess 133. The recess 133 is defined in the underside of the pivotal member 13 and located between the end portion 131 and the pivot 132. The spring 2 is partially accommodated in the recess 133 and biased between the inner end of the recess 133 and the case 11 so as to protrude the portion of the pivotal member 13 beyond the case 11. The end portion 131 is located beside the stop 31 to restrict the stop 31 from pivoting when no arrow 50 is loaded. The case 11 includes a front end 111, a rear end 112 and a bottom 113 which is formed between the front end 11 and the rear end 112. A room 114 is formed in the case 11. A slot 115 is defined through the front end 111 and communicates with the room 114. Two elongate holes 116 are respectively defined through two sides of the case 11 and communicate with the room 114. An opening 17 is defined through the bottom 113 and communicates with the room 114. The portion of the activation member 3 protrudes through the opening 117 and is pivotably connected to the link 4. A separation portion 118 is formed in the rea end of the room 114 so as to form a slide path 114A. The pivotal member 13 is pivotably connected to the front end 111 and is biased by the spring 2 so that a portion of the pivotal ember 13 protrudes beyond the slot 115. The operation assembly 12 is located in the room 114 of the case 11. The operation assembly 12 includes a hook member 121, a controller 122, an engaging member 123, a resilient member 124 and an assistance spring 125. The controller 122 is slidably located in the slide path 114A and includes multiple protrusions 122A which are located corresponding to the elongate slots 116. The user uses the protrusions 122A to move the controller 122 to close to the hook member 121 to unlock the safety status. The hook member 121 is pivotably connected to room 114 of the case 11 and located in the case 11. The hook member 121 includes a first hook 1211 which is an inverted U-shaped hook, a second hook 1212 and a push portion 1213. The push portion 1213 is located above the controller 122. The resilient member 124 is biased between the push portion 1213 and the case 11. The hook member 121 is pivoted and the first hook 1211 protrudes beyond the slot 115 and hooks the string 40. The engaging member 123 is pivotably located in the room 114 and located below the separation portion 118. The engaging member 123 includes a first end 1231 and a second end 1232. The first end 1231 hooks the second hook 1212 after the hook member 121 is pivoted. The assistance spring 125 is biased between the second end 1232 and the separation portion 118. When there is no arrow located in the slot 115. The pivotal member 13 is biased by the spring 2 and protrudes beyond the slot 115 and located close to the stop 31. The pivotal member 13 restricts the end portion 131 to pivot so that the trigger 30 is restricted from being pulled. Therefore, during operation to the crossbow 10, when the crossbow 10 is in the string-cocked mode while no arrow 50 is loaded, the pivotal member 13 is biased by the spring 2 to normally push the end portion 131 beyond the slot 115. The trigger 30 uses the link 4 to in-directly control the pivotal action of the activation member 3. The stop 31 is pivoted toward the pivotal member 13 when the activation member 3 pivots. The end portion 131 of the pivotal member 13 is located close to the stop 31, so that the stop 31 can only pivot a limited range and is stopped by the end portion 131. This causes that the trigger 30 cannot be pulled further so as to prevent the string 40 from bouncing back by accidentally action to the trigger 30, and the user is protected from being injured by the string 40, as shown in FIGS. 5 and 6.

Figure 7:
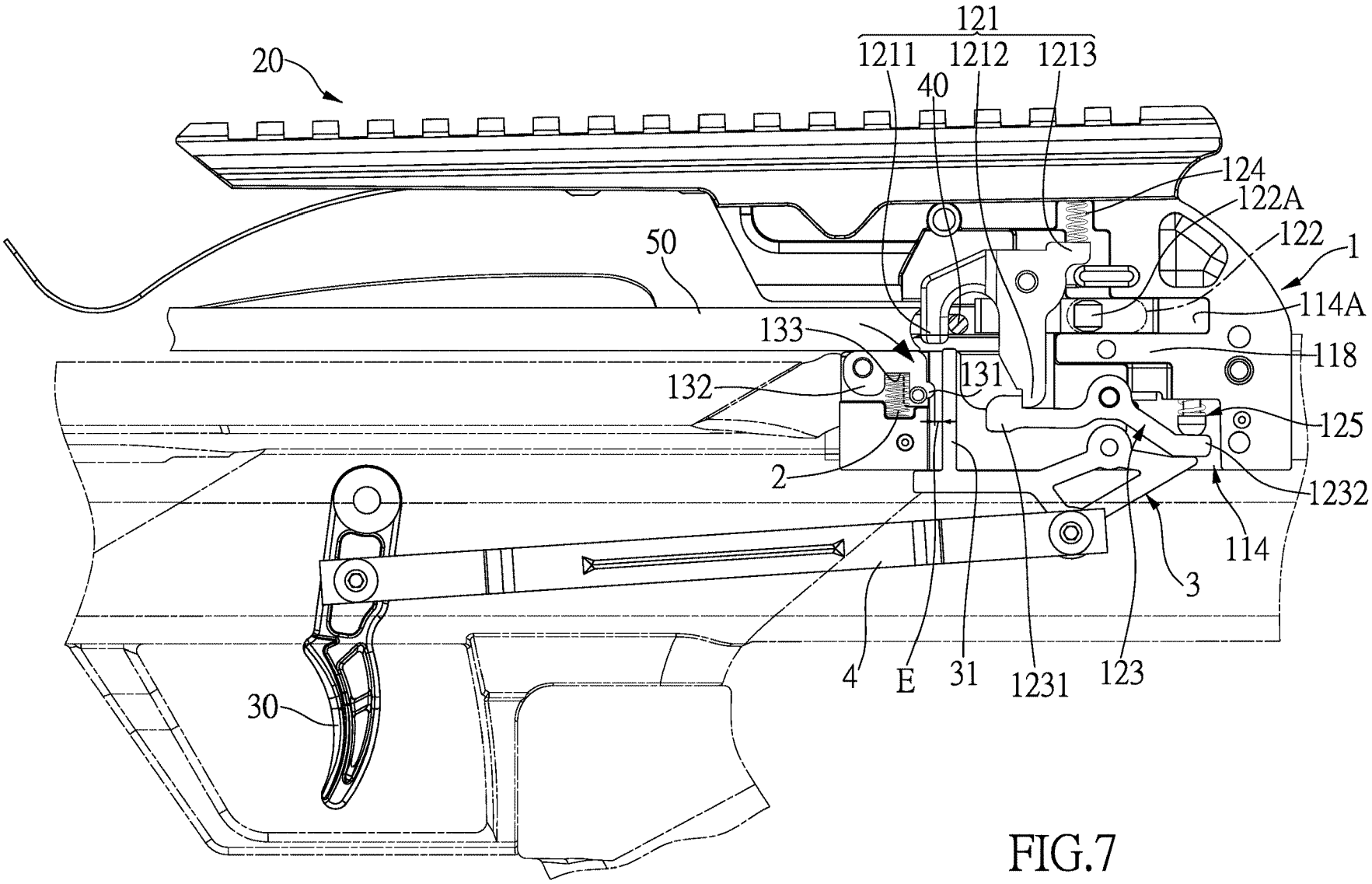
FIG. 7 shows that the crossbow is in the ready-to-shoot mode, and an arrow is loaded.
Figure 8:
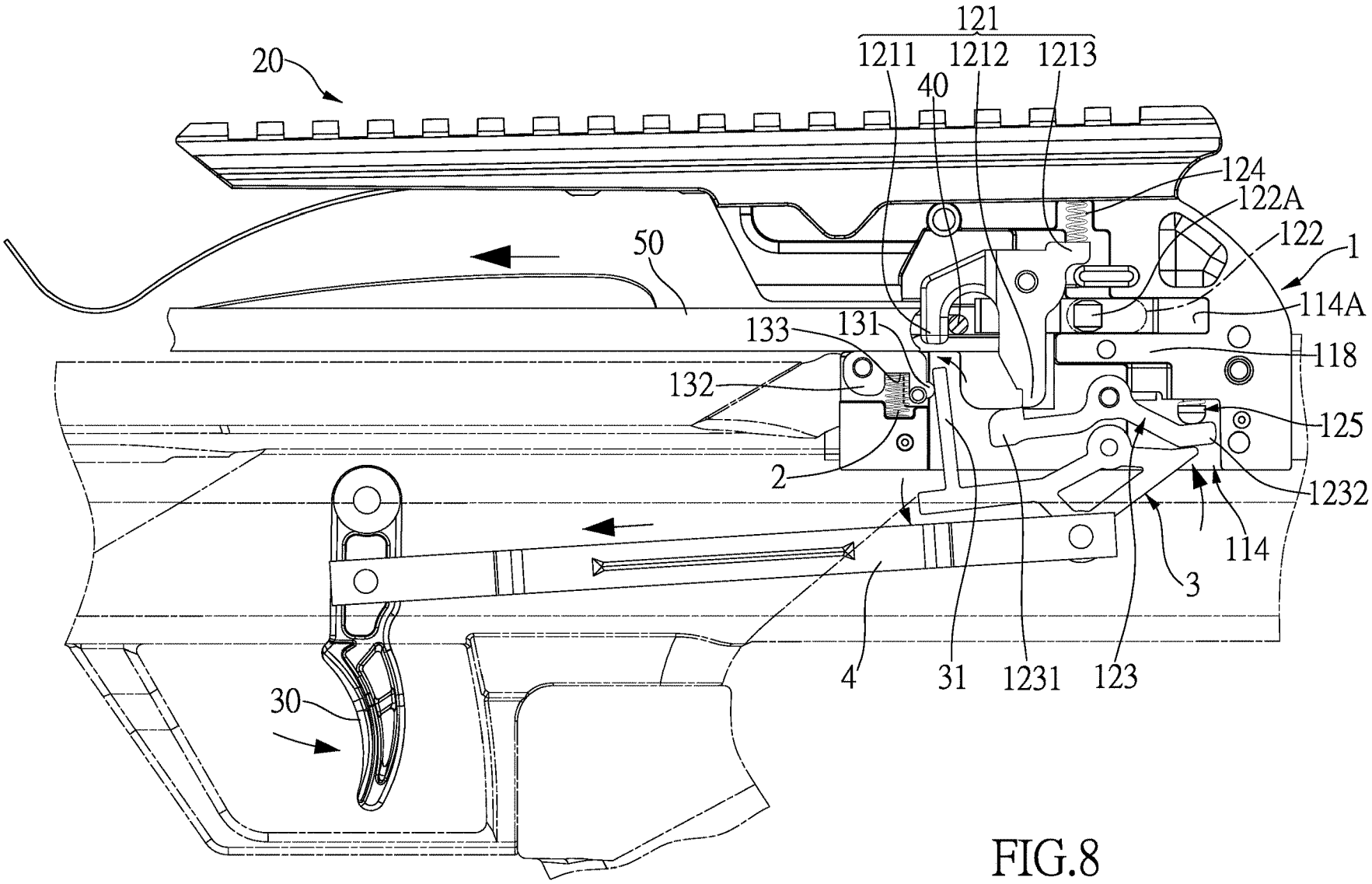
FIG. 8 shows that the trigger in FIG. 7 is pulled and the arrow shoots out.

When the arrow 50 is loaded, the pivotal member 13 is pushed by the arrow 50 and pivots in the room 14, and compresses the spring 2. The distance between the end portion 131 and the stop 31 is changed. Specifically, when the operation assembly 12 is operated within the case 11 to form the ready-to-shoot mode wherein the arrow 50 is loaded, the distance between the pivotal member 13 and the stop 31 is defined as "e" under the string-cocked mode, and the distance between the pivotal member 13 and the stop 31 is defined as "E" under the ready-to-shoot mode. The distance "E" is greater than the distance "e". When the pivotal member 13 is pushed, the end portion 131 moves downward so that the stop 31 can pivot without being stopped. The user is able to pull the trigger successfully to release the string 40 to shoot the arrow 50. When the string 40 is released, the pivotal member 13 is not pushed by the arrow 50, the recovery force of the spring 2 pivots the end portion 131 upward so that the end portion 131 protrudes beyond the slot 115 again as shown in FIGS. 7 and 8.

The safety device of the present invention restricts the trigger 30 from being pulled when the crossbow 10 is in the string-cocked mode and no arrow 50 is loaded. This is because stop 31 is stopped by the end portion 131, and the trigger 30 cannot be pulled.

While we have shown and described the embodiment in accordance with the present invention, it should be clear to those skilled in the art that further embodiments may be made without departing from the scope of the present invention.

What is claimed is:

1. A safety device for a crossbow, comprising:

a control box adapted to be connected to a shooting device of the crossbow, the control box including a case, an operation assembly and a pivotal member, the operation assembly located in a rear end of the case, the operation assembly including a hook member, a controller, an engaging member, a resilient member and an assistance spring, the hook member pivotably connected to the case and located in the case, the hook member including a first hook, a second hook and a push portion, the resilient member biased between the push portion and the case, the resilient member pivoting the hook member to release the string, the pivotal member pivotably connected to the case and located in a front end of the case, the pivotal member being biased by a spring, a portion of the pivotal member protruding beyond the case and located corresponding to the operation assembly;

an activation member pivotably connected to the case and located beneath the operation assembly, the activation member having a portion thereof partially protruding beyond the case, the activation member having a stop extending therefrom which is located in the case, the stop located between the operation assembly and a trigger;

a link pivotably connected between the trigger and the portion of the activation member that protrudes beyond the case, and wherein when the operation assembly is operated to be a string-cocked mode in which no arrow is loaded, a string is pulled toward the case and the hook member is pivoted, the first hook hooks the string, the second hook hooks a first end of the engaging member, a second end of the engaging member is based by the assistance spring and contacts the activation member;

when the controller is moved toward the hook member, the stop of the activation member is restricted by the portion of the pivotal member that protrudes beyond the case so that the activation member cannot be pivoted, and the trigger is restricted by the activation member and cannot be pulled.

2. The crossbow as claimed in claim 1, wherein the pivotal member includes an end portion, a pivot and a recess, the recess is defined in an underside of the pivotal member and located between the end portion and the pivot, the spring is partially accommodated in the recess and biased between an inner end of the recess and the case so as to protrude the portion of the pivotal member beyond the case, the end portion is located beside the stop to restrict the stop from pivoting when no arrow is loaded.

3. The crossbow as claimed in claim 2, wherein the case includes a front end, a rear end and a bottom which is formed between the front end and the rear end, a room is formed in the case, a slot is defined through the front end and communicates with the room, two elongate holes are respectively defined through two sides of the case and communicate with the room, an opening is defined through the bottom and communicates with the room, the portion of the activation member protrudes through the opening and is pivotably connected to the link, a separation portion is formed in the ma rear end of the room so as to form a slide path.

4. The crossbow as claimed in claim 3, wherein the operation assembly includes a hook member, a controller, an engaging member, a resilient member and an assistance spring, the controller is slidably located in the slide path and includes multiple protrusions which are located corresponding to the elongate slots, the hook member is pivotably located in the room and includes a first hook, a second hook and a push portion, the push portion is located above the controller, the resilient member is biased between the push portion and the case, the hook member is pivoted and the first hook protrudes beyond the slot and hooks the string, the engaging member is pivotably located in the room and located below the separation portion, the engaging member includes a first end and a second end, the first end hooks the second hook after the hook member is pivoted, the assistance spring is biased between the second end and the separation portion, when there is no arrow located in the slot, the pivotal member is biased by the spring and protrudes beyond the slot and located close to the stop, the pivotal member restricts the end portion to pivot so that the trigger is restricted from being pulled.

5. The crossbow as claimed in claim 1, wherein the operation assembly is operated within the case to form a ready-to-shoot mode wherein an arrow is loaded, a distance between the pivotal member and the stop is defined as "e" under the string-cocked mode, a distance between the pivotal member and the stop is defined as "E" under the ready-to-shoot mode, "E" is greater than "e".

6. The crossbow as claimed in claim 1, wherein the operation assembly is operated within the case to form a ready-to-shoot mode wherein an arrow is loaded, a distance between the pivotal member and the stop is defined as "e" under the string-cocked mode, a distance between the pivotal member and the stop is defined as "E" under the ready-to-shoot mode, "E" is greater than "e".

7. The crossbow as claimed in claim 4, wherein the operation assembly is operated within the case to form a ready-to-shoot mode wherein an arrow is loaded, a distance between the pivotal member and the stop is defined as "e" under the string-cocked mode, a distance between the pivotal member and the stop is defined as "E" under the ready-to-shoot mode, "E" is greater than "e".

* * * * *